US005256100A

United States Patent [19]

Wang

[11] Patent Number: 5,256,100

[45] Date of Patent: Oct. 26, 1993

[54] TOY GUN HAVING A REPLACEABLE FIRING MECHANISM

[76] Inventor: Kun-Meng Wang, No. 2-2, Pei Hsing Road, Tai Pao City, Chiayi Hsien, Taiwan

[21] Appl. No.: 886,898

[22] Filed: May 22, 1992

[51] Int. Cl.[5] ..... A63H 33/30; A63H 5/00; F41C 3/06

[52] U.S. Cl. ..... 446/473; 446/475; 446/401; 446/397; 42/58

[58] Field of Search ..... 446/473, 475, 401, 397, 446/405; 42/65, 58

[56] References Cited

U.S. PATENT DOCUMENTS

| | | | |
|---|---|---|---|
| 2,625,927 | 1/1953 | Rosenbloom | 446/473 X |
| 3,219,023 | 11/1965 | Ryan | 446/473 X |
| 3,342,171 | 9/1967 | Ryan et al. | 446/405 X |
| 4,216,609 | 8/1980 | Ortiz | 446/475 X |
| 4,598,491 | 7/1986 | Noble | 446/401 X |

FOREIGN PATENT DOCUMENTS

| | | | |
|---|---|---|---|
| 2102100 | 7/1972 | Fed. Rep. of Germany | 446/473 |
| 2158725 | 7/1972 | Fed. Rep. of Germany | 446/473 |

*Primary Examiner*—Robert A. Hafer
*Assistant Examiner*—D. Neal Muir
*Attorney, Agent, or Firm*—Browdy and Neimark

[57] ABSTRACT

A replaceable firing mechanism for a toy gun which is housed in a case having a pair of symmetric halves that are secured together by a number of screws and a revolving cylinder having a plurality of chambers housing confetti in various shapes and colors is disposed in front of the case and can be revolved and actuated by the firing mechanism to discharge the confetti. The present firing mechanism is characterized in the ready and easy replacement thereof. When a toy gun is out of order in the firing mechanism and must be fixed, the only procedure taken is to replace the old case with a new one. For the firing mechanism housed in a case can be exchanged between a line of standardized toy guns so that the cost of production of the guns can be effectively lowered, and the maintenance thereof is also made easy.

3 Claims, 4 Drawing Sheets

TOY GUN HAVING A REPLACEABLE FIRING MECHANISM

BACKGROUND OF THE INVENTION

1. Field of the Invention

The present invention relates to a readily replaceable firing mechanism which is housed in a case mounted between a pair of symmetric halves of a toy gun. When the firing mechanism is fired confetti housed in a revolving cylinder is discharged. A firing mechanism can be readily exchanged with each other, causing the production cost and maintenance fee thereof to drop in one aspect; and making the game have more fun in another.

2. Description of the Prior Art

As shown in FIG. 1, the prior art toy gun comprises a pair of gun body halves and a firing mechanism and a revolving cylinder with a plurality of chambers wherein the firing mechanism has a trigger 21 pivotally located on a pin element 11 fixed inside the gun body with a follower arm 22 and a coil spring 23 connected thereto. The trigger 21 is engaged with a hammer 24 which is pivotally mounted on a pin 12 fixed inside the gun body and is retractably actuated by a bias wire spring 25. The trigger 21 is engages with the hammer 24 and when the trigger 21 is pressed down a certain distance, the follower arm 22 is made to travel forward and the hammer 24 move backward with the spring 23 compressed. In the meanwhile, the follower arm 22 will urge the revolver 14 to rotate one step forward by way of the protrusion block 141, ending up with a new chamber of the plurality of chambers aiming at the gun tube. When the trigger is continually pressed down, the hammer 24 will finally move out of engagement with the trigger 21, resulting in the hammer 24 actuated by a bias wire spring 25 forcefully pivoting forward and hitting the explosive cap disposed in the revolving cylinder 14 and the stuffed paper debris are discharged by the explosion of the explosive cap.

The prior art toy gun is designed with several inherent problems which are presented as below:

1. It has been a commercial trend for toy manufactures to produce a line of products which are varied mainly in structural appearance to meet rapidly changing market's requirements. However, the inner components thereof are unavoidably changed in size and mechanical structure, resulting in the incompatibility among their parts and the exchange of the parts becoming impossible. Thus, the cost of a new product becomes relatively high due to the waste of molding expense and the maintenance of the products becomes rather expensive.

2. The trigger parts are the most easily damaged ones because of the high frequency of operation thereof and are relatively cheap in comparison with the cost of a toy gun. 50% of the broken guns result from the malfunction of their trigger parts and are discarded due to the toy shops being not able to fix them.

3. The conventional toy gun can only discharge one type of paper debris when fired, which usually is made in a circular shape, and is not regarded as an interesting and fun making game.

SUMMARY OF THE INVENTION

The primary object of the present invention is to provide a firing mechanism for a toy gun housed in a case which is produced in a standard fashion so that it is exchangeable among the toy guns and the cost of the molding thereof can be reduced greatly as a result of the unity of the size of the firing mechanism which can be applied to a series of toy guns developed by one manufacturer.

Another object of the present invention is to provide a firing mechanism for a toy gun which is housed in a case and can be readily replaced so as to facilitate the fixing or maintenance thereof at a low cost.

One further object of the present invention is to provide a plurality of various shapes colorful debris which can be discharged by an explosive cap from a chamber of a revolving cylinder so as to make a the toy gun more interesting.

BRIEF DESCRIPTION OF THE DRAWINGS

To make the features, operation modes and the structure of the present invention better understood by people skilled in the art, a number of drawings are given in company with a detailed description of the preferred embodiment thereof, in which.

DETAILED DESCRIPTION OF THE PREFERRED EMBODIMENT

Figure 1:
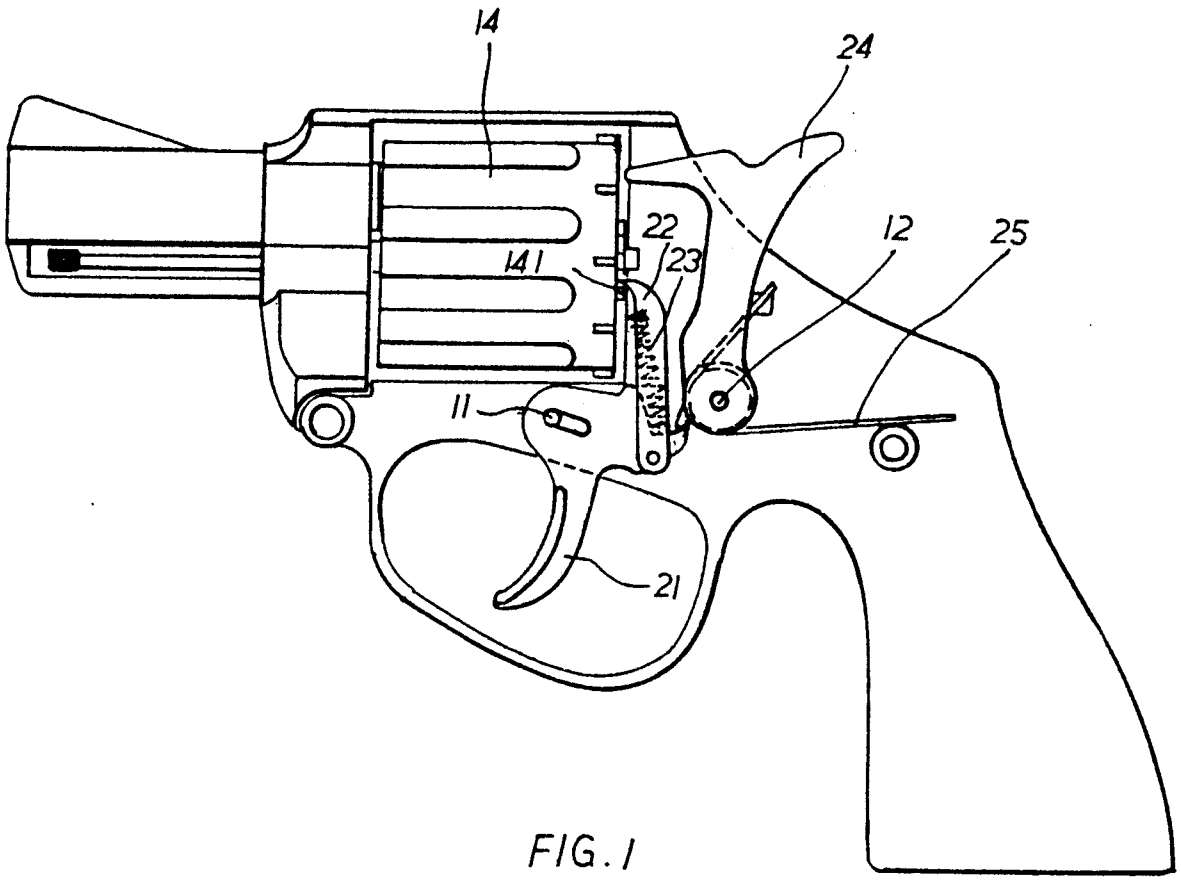
FIG. 1 (PRIOR ART)
FIG. 1 is a diagram showing a prior art toy gun.
Figure 2:
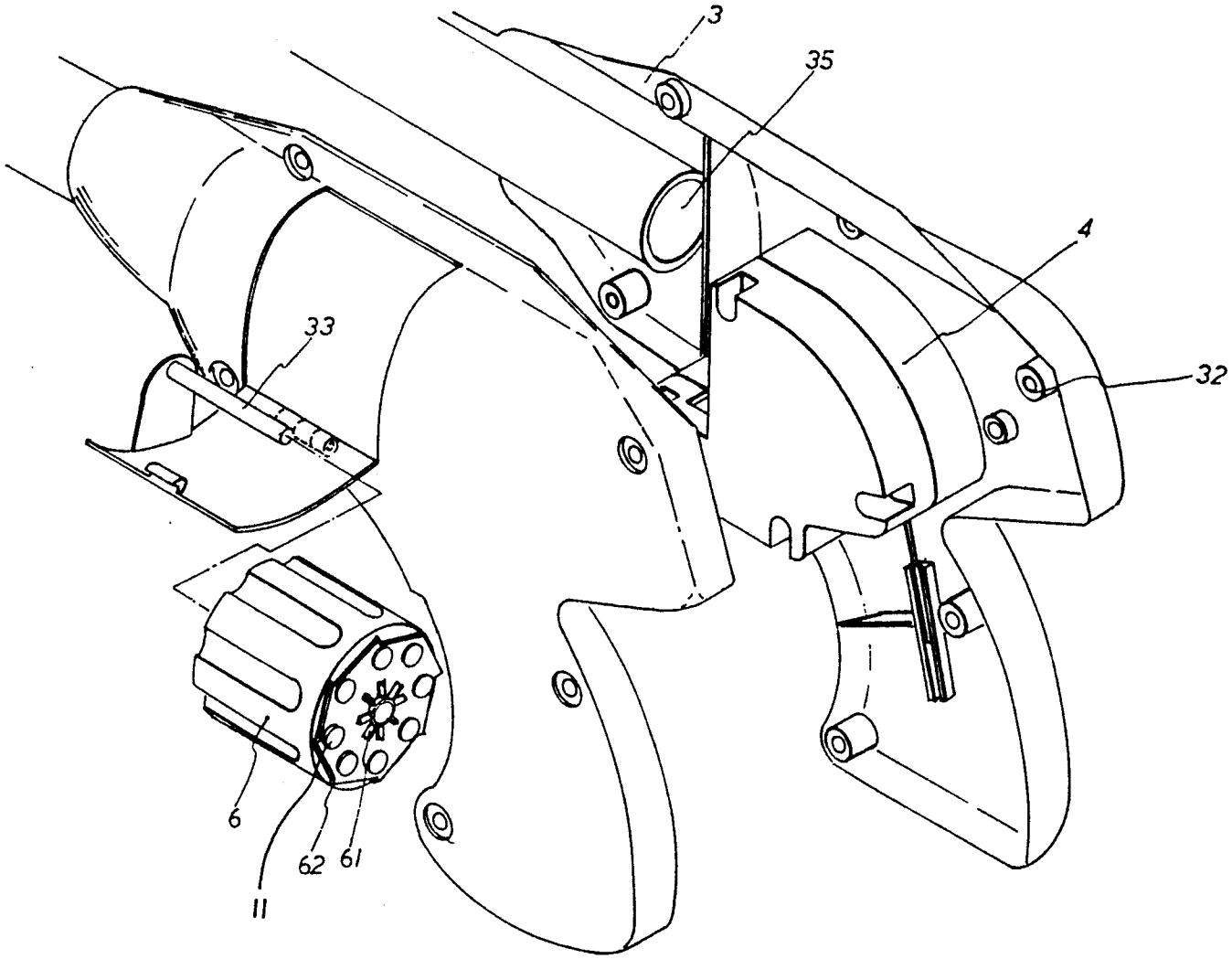
FIG. 2 is a perspective view of the present invention showing the exploded components thereof.
Figure 3:
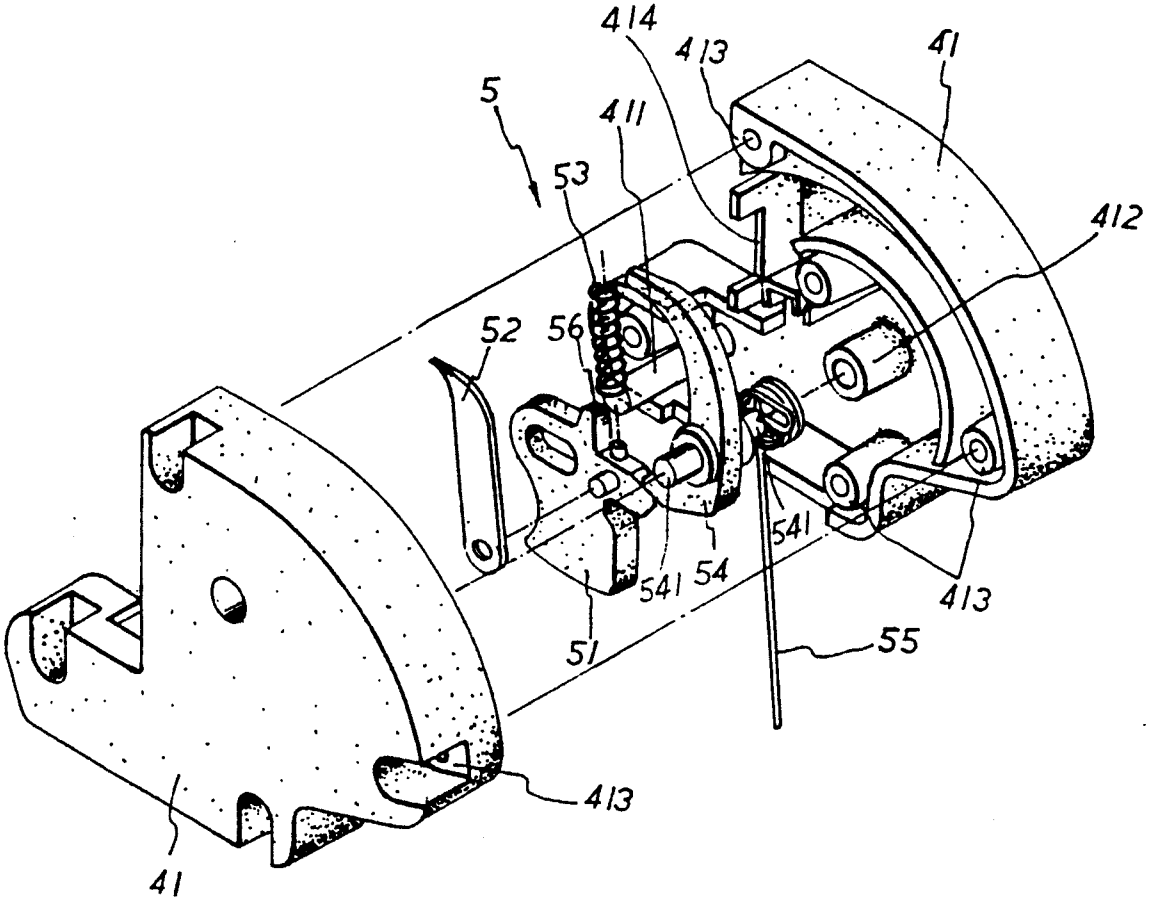
FIG. 3 is a perspective view of the firing mechanism of the present invention showing the exploded components thereof.

Referring to FIGS. 2, 3, the present toy gun mainly comprises a right and left gun body halves 3, a case 4 in which a firing mechanism 5 of the present invention is housed and a revolving cylinder 6 having a plurality of chambers 7 housing confetti 9 of various shapes. The case 4 is made up of a pair of symmetric case halves 41. A pin element 411 is secured to the case halves 41 with a trigger pivotably associated therewith and each case half 41 is provided with a positioning hole 412 so as to permit a hammer 54 to be pivotably located in the case 4. A number of screw holes 413 are disposed at the corners and the center of the case halves 41 so that the two case halves can be bound together by screws. In correspondence to the screw holes 413 of the case 4, on the gun body halves 3 are disposed a number of screw holes 32.

In assembly, the trigger 51 is pivotally engaged with the pin element 411 in the case 4 with a follower arm 52 and a spring 53 pivotally connected to the top thereof. The trigger 51 is in actuation abutment with the bottom of the hammer 54 which is pivotally engaged with the positioning holes 412 on the case halves 41 by way of the protrusion rods 541. A wire spring 55 is associated with the bottom of the hammer 54 so as to make the hammer retractably actuateable. The revolving cylinder 6 is rotatably secured to a fixing pin 33 disposed on the left gun body half 3.

Figure 4:
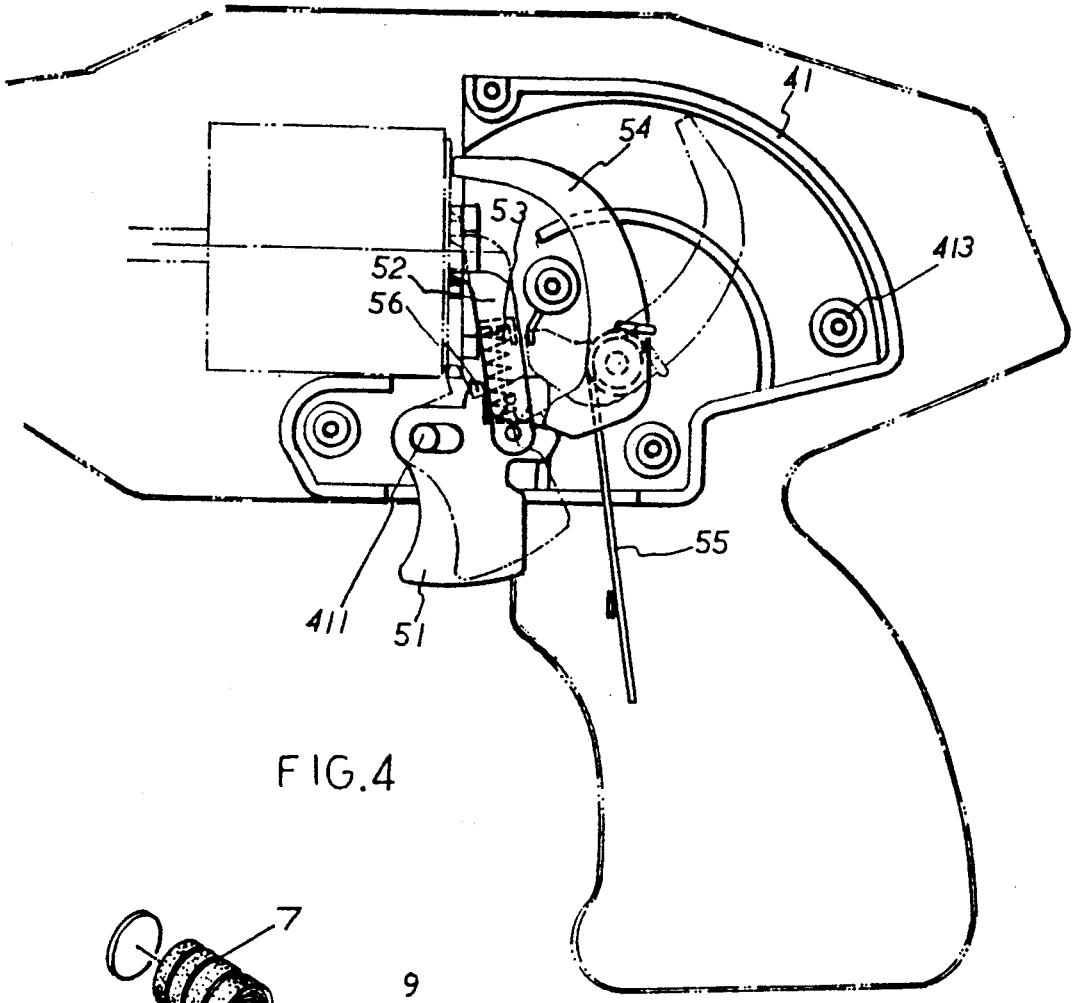
FIG. 4 is a sectional diagram showing the operational mode of the present invention.

Referring to FIG. 4, when the trigger 51 is pressed backward by the index finger of an operator, the follower arm 52 is made to move forward along therewith and the hammer 54 is forced to pivot backward while the coil spring 53 is compressed. At this moment, the follower arm 52 is urged against one of the spinning protrusions 61 so as to make the revolving cylinder 6 revolve one step forward and a loaded chamber 9 and explosive cap 11 are then placed in alignment with the gun tube 35 ready to be fired. As the trigger 51 is pushed continually backward to such a point that the hammer pin 54 will be moved out of engagement with the trigger 51 and the hammer 54 biased by the spring 55 will forcedly bounce back. In the meanwhile, the abutment protrusion 56 disposed at the top of the trigger 51 is leaning against the engagement corner 62 of the revolver 6 so that the hammer 54 will hit explosive cap of a new chamber 9 aligned through the opening 414 of the case 4 and the paper debris loaded in this chamber will be discharged therefrom.

Figure 5:
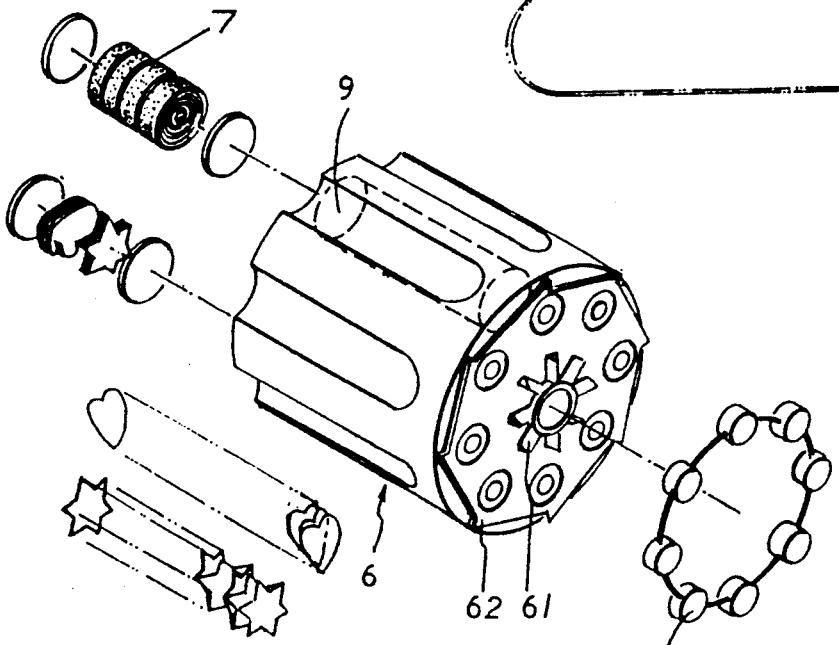
FIG. 5 is a diagram showing the colorful debris of various figures being loaded in one of the chambers of a revolving cylinder.

As shown in FIG. 5, the colorful paper debris stuffed in each of the chambers 9 of the revolving cylinder 6 can be designed and manufactured in various geometric or animal figures, such as an asterisk, an elephant, and a heart form so that the toy gun can be played with more fun and interest.

It becomes apparent that the replaceable firing mechanism of the present invention can be exchangeable secured to any standardized toy guns designed and produced by a manufacture so that the molding expense of the line of the toy guns can be greatly reduced in one aspect. The easy replacement of the firing mechanism of the present invention permits the broken toy guns to be repaired at a low cost with the maintenance thereof with ease in another. Moreover, the colorful paper debris discharged by the toy gun are made in various shapes, making the game more fun and interesting.

I claim:

1. A toy gun having a replaceable firing mechanism comprising:

left and right gun body halves;

a case having a pair of symmetric halves being detachably disposed between said left and right gun body halves;

a firing mechanism substantially housed within said case;

said firing mechanism comprising a spring-biased trigger and a spring-biased hammer each respectively rotatably mounted in said case;

wherein rotation of said trigger rotates said hammer against a spring until out of engagement;

a revolving cylinder having a plurality of chambers;

said revolving cylinder rotatably engaged to one of said left and right gun body halves;

each of said plurality of chambers housing confetti;

an explosive cap engaged at an end of said each of said plurality of chambers between said revolving cylinder and said case;

wherein, rotation of said trigger until out of engagement with said hammer releases said hammer through an opening in said case to permit ignition of an explosive cap in alignment with said hammer and discharge of confetti in a chamber of said plurality of chambers corresponding to said explosive cap in alignment with said hammer.

2. A toy gun as claimed in claim 1 wherein said case is provided with screw holes at corners and a center of each of said pair of symmetric halves which are in alignment with screw holes disposed on said gun body halves.

3. A toy gun as claimed in claim 1 wherein said colorful paper debris can be cut in various geometric and animal shapes.

* * * * *